United States Patent [19]

Toyoda et al.

[11] 3,958,902

[45] May 25, 1976

[54] ELECTROMAGNETIC PUMP

[75] Inventors: Akira Toyoda; Shizuo Arima, both of Tokyo, Japan

[73] Assignee: Taisan Industrial Co., Ltd., Tokyo, Japan

[22] Filed: May 22, 1975

[21] Appl. No.: 579,866

[30] Foreign Application Priority Data

June 14, 1974 Japan ..... 49-67027

[52] U.S. Cl. ..... 417/279; 417/417; 417/505

[51] Int. Cl.[2] ..... F04B 39/08

[58] Field of Search ..... 417/279, 417, 456, 458, 417/505

[56] References Cited

UNITED STATES PATENTS

| | | | |
|---|---|---|---|
| 2,765,747 | 10/1956 | Aumick | 417/505 |
| 2,770,394 | 11/1956 | Mueller | 417/505 |
| 3,380,387 | 4/1968 | Kofink | 417/417 |
| 3,468,257 | 9/1969 | Kofink | 417/415 |
| 3,877,841 | 4/1975 | Nakamura | 417/505 |

*Primary Examiner*—William L. Freeh
*Assistant Examiner*—G. P. La Pointe
*Attorney, Agent, or Firm*—Kane, Dalsimer, Kane, Sullivan and Kurucz

[57] ABSTRACT

An electromagnetic pump comprising an electromagnetic coil, magnetic paths constituting a yoke arranged in the electromagnetic coil, an electromagnetic plunger reciprocatorily mounted in the electromagnetic coil, and a main body including a suction port, a discharge port and suction and discharge valve means and connected to the electromagnetic coil. At least one of the magnetic paths has a reduced cross-sectional area portion at one end portion thereof disposed on the longitudinal axis of the electromagnetic coil and is formed with a magnetic gap between the reduced cross-sectional area portion and the end portion of the electromagnetic plunger. A movable iron member of the cylindrical shape is arranged in the magnetic gap in which the lines of magnetic force are concentrated in passing through the magnetic path. The movable iron member is moved upwardly by the electromagnetic force to facilitate further concentration of the lines of magnetic force therein. By this arrangement, the movable iron member functions to open a valve seat when an electric current is passed to the electromagnetic coil and increases the output of the pump.

10 Claims, 2 Drawing Figures

ELECTROMAGNETIC PUMP

BACKGROUND OF THE INVENTION

This invention relates to an electromagnetic plunger having a built-in electromagnetic valve means.

Generally, a pump may be used to draw a liquid by suction from a position which is disposed at a higher level than the pump itself and to discharge the same after delivering it under pressure to the desired destination, or may be used to draw a liquid by suction from a position which is disposed at a lower level than the pump itself and to eject the same after delivering it under pressure to the desired destination. In such case, the pressure of the head of the liquid may open the suction valve or the discharge valve of the pump to cause the liquid to ooze or leak out while the pump is inoperative, or the liquid may be caused to eject through the valve by the pressure of the head till the pressure on the discharge side of the pump falls. In order to avoid such trouble, it has hitherto been customary to provide the pump with an electromagnetic valve which is mounted at the discharge side of the pump as an independent unitary member so as to thereby interrupt the discharge of the liquid when the pump is rendered inoperative.

Electromagnetic plunger pumps each having a built-in electromagnetic valve include an electromagnetic piston pump of the solenoid type disclosed in Japanese Laid-Open Patent Gazette No. Sho 48-82407 (Japanese patent application Ser. No. Sho 47-12037) and a plunger pump of the solenoid type which may also employ an electromagnetic valve disclosed in Japanese Laid-Open Pat. Gazette No. Sho 49-21703 (Japanese patent application Ser. No. Sho 47-61308). In either case, the liquid flows through the electromagnetic plunger case to the discharge port of the pump, with the electromagnetic means being a part of the magnetic head or a composite magnetic head. Thus it has been difficult or almost impossible to provide the electromagnetic means on the magnetic head, on the vertical axis of the electromagnetic coil or on the extension of the electromagnetic coil where the discharge capacity of the pump can be readily adjusted. The electromagnetic means of the prior art has also been inconvenient to operate.

SUMMARY OF THE INVENTION

A main object of the present invention is to provide an electromagnetic pump of high output in which the fluid does not flow through the case of the electromagnetic plunger, and in which the fluid is caused to be discharged from the pump by means of a movable cylindrical iron member which is arranged in the main body of the pump and functions as an electromagnetic valve.

Another object of the invention is to provide an electromagnetic pump in which the movable iron member is coated on its surface with a film of a nonmagnetic metal or a synthetic resinous material or both, so that the electromagnetic connection of the iron member to the magnetic paths due to the residual magnetism therein can be avoided when no current is passed to the electromagnetic coil, the application of such coat also serving to prevent rust formation on the iron member or wear thereof arising from sliding movement.

Another object of the invention is to provide an electromagnetic pump in which a movable magnetic head is arranged in a magnetic path disposed at an end of the electromagnetic coil opposite to the end thereof at which the movable iron member is arranged in a magnetic path, whereby the distance between the magnetic head and the electromagnetic plunger or the magnetic gap can be adjusted as desired to obtain a maximum output or desired output by utilizing the magnetic force most effectively.

Still another object of the invention is to provide an electromagnetic pump in which the magnetic force of attraction applied to the electromagnetic plunger can be varied by effecting adjustments of the restitution load of the return spring supporting the electro-magnetic plunger, the operative position of the electromagnetic plunger relative to the electromagnetic coil and the magnetic gap formed in the magnetic path, whereby a maximum or desired output can be produced by adjusting the discharge capacity of the pump itself.

Still another object of the invention is to provide an electromagnetic plunger in which air or gas produced from the liquid is stored in the upper portion of the plunger case which air or gas is effective to reduce the resistance offered by the liquid to the operation of the electromagnetic plunger which is a free piston, whereby the electromagnetic plunger can satisfactorily function as a spring hammer.

Still another object of the invention is to provide an electromagnetic pump which comprises a pressure control valve mechanism interposed between the discharge valve of the pump and the electromagnetic valve means and serving as both a pressure-reducing throttle and an accumulator.

A further object of the invention is to provide an electromagnetic valve in which the suction valve and/or the discharge valve can be removed for inspection, cleaning and replacement without removing the pump from the pipe in which it is mounted.

Additional and other objects and features of the invention will become evident from the description set forth hereinafter when considered in conjunction with the accompanying drawings. According to the invention, there is provided an electromagnetic pump comprising an electromagnetic coil, magnetic paths arranged in said electromagnetic coil and constituting a yoke, an electromagnetic plunger reciprocatorily arranged in a plunger case mounted in said magnetic paths in said magnetic coil and adapted to be moved upwardly along the longitudinal axis of said plunger case by the electromagnetic force and moved dowanwardly by the viasing force of a return spring, a main body connected to said electromagnetic coil, said main body comprising a suction port and a discharge port for a fluid, suction and discharge valve means for drawing the fluid by suction through said suction port and discharging the same through said discharge port as said electromagnetic plunger moves in reciprocatory movement, and an electromagnetic valve chamber maintained in communication with said suction and discharge valve means and operatively associated with the electromagnetic plunger, at least one of said magnetic paths having its cross-sectional area reduced at one end thereof which is associated with said electromagnetic valve chamber and disposed on the longitudinal axis of the electromagnetic coil so as to define a magnetic gap between outer periphery of the electromagnetic plunger and reduced cross-sectional area portion of said magnetic path, and a movable iron member of the cylindrical shape arranged in said magnetic path to facilitate concentration and passing of lines of magnetic force necessary for the operation of the electromagnetic pump, said movable iron member being adapted to open and close a valve seat interposed between said electromagnetic chamber and said discharge port, whereby said movable iron member opens said valve seat as an electric current is passed to said electromagnetic plunger so as to increase the output of the electromagnetic plunger.

Figure 1:
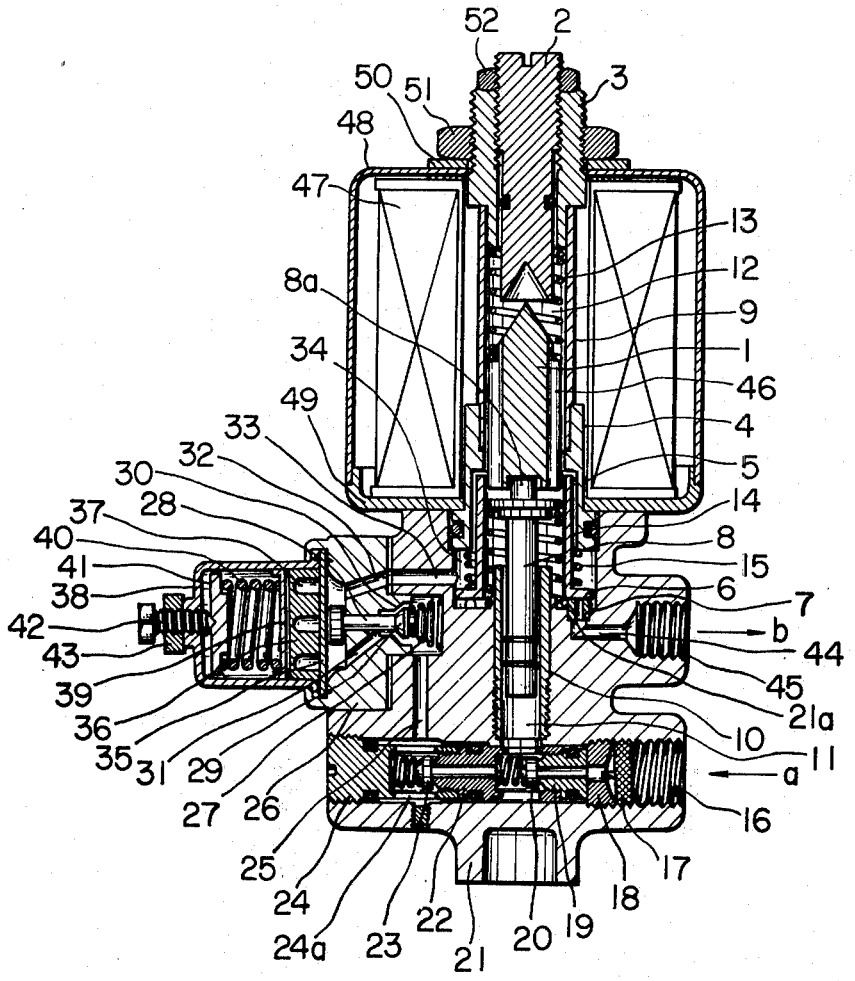
FIG. 1 is a vertical sectional view of the electromagnetic pump comprising one embodiment of the invention.

DESCRIPTION OF THE PREFERRED EMBODIMENTS:

In FIG. 1, an electromagnetic plunger 1 slidably fitted in a plunger case 9 made of a nonmagnetic material and arranged on the longitudinal axis of an electromagnetic coil 47 to extend therethrough is in engagement with a tappet portion 8a of a discharge plunger 8 reciprocatorily slidably mounted in a cylinder liner 10 provided in a main body 21 of the pump. The electromagnetic plunger 1 is resiliently held by a return spring 13 mounted between a magnetic path 3 provided at the top of the plunger case 9 in airtight relation and the plunger 1 and an auxiliary spring 13 mounted between the plunger 1 and a spring seat 21a. An externally threaded magnetic head 2 is threadably fitted in a central portion of the magnetic path 3 which is internally threaded.

Another magnetic path 4 is fitted in airtight relation between a lower end portion of the plunger case 9 and a lower end portion of the magnetic coil 47. The magnetic path 4 has an increased inner diameter portion which starts at a portion thereof disposed in the vicinity of the lower end of the electromagnetic plunger 1 and extends downwardly therefrom, so that the cross-sectional area of the magnetic path 4 is reduced. A gap is thus defined between outer periphery of the electromagnetic plunger 1 and the reduced cross-sectional area portion of the magnetic path 4 and receives therein a movable iron member 5 of the cylindrical shape for reciprocatory sliding motion therein. The movable iron member 5 is formed at its lower end with a flange 5 which is associated with a valve seat 7 to constitute an electromagnetic valve. The member 5 is normally urged to move downwardly by the biasing force of a spring 15 mounted between the magnetic path 4 and the flange 6, so that the electromagnetic valve is closed.

Mounted in communication with a suction port 16 formed in the main body 21 are a suction valve seat 19, a suction valve 20, a discharge valve seat built-in suction valve cylinder 22, a discharge valve 23 and a discharge valve cylinder 24, with the suction valve cylinder 19, discharge valve seat built-in suction valve cylinder 22 and discharge valve cylinder 24 being successively connected together to form a unit which is threadably connected to the main body 21 through an externally threaded portion of the discharge valve cylinder 24. By this arrangement, it is possible to perform inspection, cleaning or replacement of the suction valve section and the discharge valve section of the electromagnetic pump without disconnecting pipes which are connected to the suction port 21 and a discharge port 45 in the main body 21. In this respect, the electromagnetic pump according to the invention is more convenient than the electromagnetic pumps disclosed in Japanese Laid-Open Pat. Gazette No. Sho 48-82407 and Japanese Laid-Open Pat. Gazette No. Sho 49-21703 referred to hereinabove.

The discharge valve cylinder 24 is maintained in communication, through a lateral opening **24*a* formed therein and a vertical duct 25 formed in the main body 21.** A pressure control valve mechanism has a pressure-reducing throttle valve and concurrently serves as an accumulator.

The pressure control valve mechanism includes a valve body 26 which is attached to the main body 21 and which has mounted in its central portion a valve stem 28 supporting a valve 29 for reciprocatory sliding movement. The pressure control valve mechanism also includes a valve seat 30 for the valve 29 which is normally urged by the biasing force of a spring 27 against the valve seat 30.

An operation diaphragm 35 located on a side of the pressure control valve mechanism opposite to the side on which the valve seat 30 is located is held between a cap 38 and the main body 21.

A resilient member 36 of the cylindrical shape made as of a synthetic resinous material and having formed therein with a plurality of cavities 37, which are circular, elliptic, rounded polygonal or the like in shape and arranged in the pattern of a honeycomb is located at an open end of the cap 38 disposed substantially at right angles to the center axis of the cap 38, with the opening of the cap 38 being maintained in intimate contact with one surface of the operation diaphragm 35. A pressure control spring 40 is mounted between spring seats 39 and 41 in the cap 38 to urge the resilient member 36 against the operation diaphragm 35. The biasing force of the pressure control spring 40 can be adjusted by turning a pressure control screw 42 threadably connected to the cap 38 and mounting a nut 43 for fixing the pressure control spring 42 in place.

The valve body 26 is formed therein with an inlet duct 31 and an outlet duct 32. The outlet duct 32 is maintained in communication with the discharge port 45 through a communication duct 33, an electromagnetic valve chamber 34, a valve seat 7 and a communication duct 44 which are provided in the main body 21.

A coil cover 48 enclosing the electromagnetic coil 47, a lower plate 49, and a washer 50 and a clamp nut 51 for securing the coil cover 48 in place constitute a yoke together with the magnetic paths 3 and 4. 52 is a lock nut threadably connected to the magnetic head 2 for effecting adjustments of the magnetic attraction force.

In the electromagnetic pump of the aforementioned construction, if an electric current is intermittently passed to the electromagnetic coil 47, the discharge plunger 8 will move in reciprocatory sliding movement in a cylinder chamber 11 of the cylinder liner 10 by virtue of the magnetic force of attraction and the biasing force of the return spring 13. The result of the reciprocatory sliding movement of the discharge plunger 8 is that a fluid introduced into the pump through the inlet port 16 in the direction of an arrow *a* is passed, through a filter 17, a filter stopper 18, the suction valve 20 and a lateral opening formed in the discharge valve seat built-in suction valve cylinder 22, into the cylinder 11 from which the fluid flows through the discharge valve 23 and the communication duct 25 to the pressure control valve mechanism from which the fluid flows through the communication duct 33, the electromagnetic valve chamber 34, the valve seat 7 and the communication duct 44 to the discharge port 45 to be discharged therethrough in the direction of an arrow *b*.

As aforementioned, the magnetic path 4, which forms a part of the yoke, has an increased inner diameter portion at its lower end portion so that the cross-sectional area of the magnetic path is reduced. By this arrangement, the lines of magnetic force are concentrated in this reduced cross-sectional area portion of the magnetic path 4 in passing through the magnetic path when an electric current is passed to the electromagnetic coil 47. This causes the movable iron member 5, which is mounted in the gap defined between the outer periphery of the electromagnetic plunger 1 and the reduced cross-sectional area portion of the magnetic path 4, to be moved upwardly by the magnetic force of attraction, iron member 5 is thus brought into engagement with the magnetic path 4 to form a composite magnetic path with the magnetic path 4 to thereby facilitate the lines of magnetic force to pass therethrough in greater amounts. Thus the magnetic force of attraction is increased and the output of the pump is also increased. Upon the movable iron member 5 being moved upwardly in the figure by the magnetic force of attraction against the biasing force of the spring 15, a valve portion formed in the flange 6 is released from contact with the valve seat 7; upon the supply of the current to the electromagnetic coil 47 being interrupted, the electromagnetic force of attraction disappears and the iron member 5 is moved downwardly by the biasing force of the spring 15 to thereby bring the valve member into engagement with the valve seat 7. Thus the flange 6 and valve seat 7 perform the function of an electromagnetic valve. If a coat of non-magnetic metal or Teflon or other synthetic resinous material or both is applied to the surface of the movable iron member 5, there will be no trouble of the valve portion in the flange 6 being released from engagement with the valve seat 7 and making the closing of the valve impossible because of the movable iron core 5 remaining attracted to the magnetic path 4 due to the residual magnetism therein when the supply of the current to the electromagnetic coil 47 is interrupted. At the same time, the provision of such coat on the surface of the iron member 5 has the effect of reducing the resistance offered to the sliding movement of the iron member 5 due to friction and also of preventing rust formation on the iron member 5.

Figure 2:
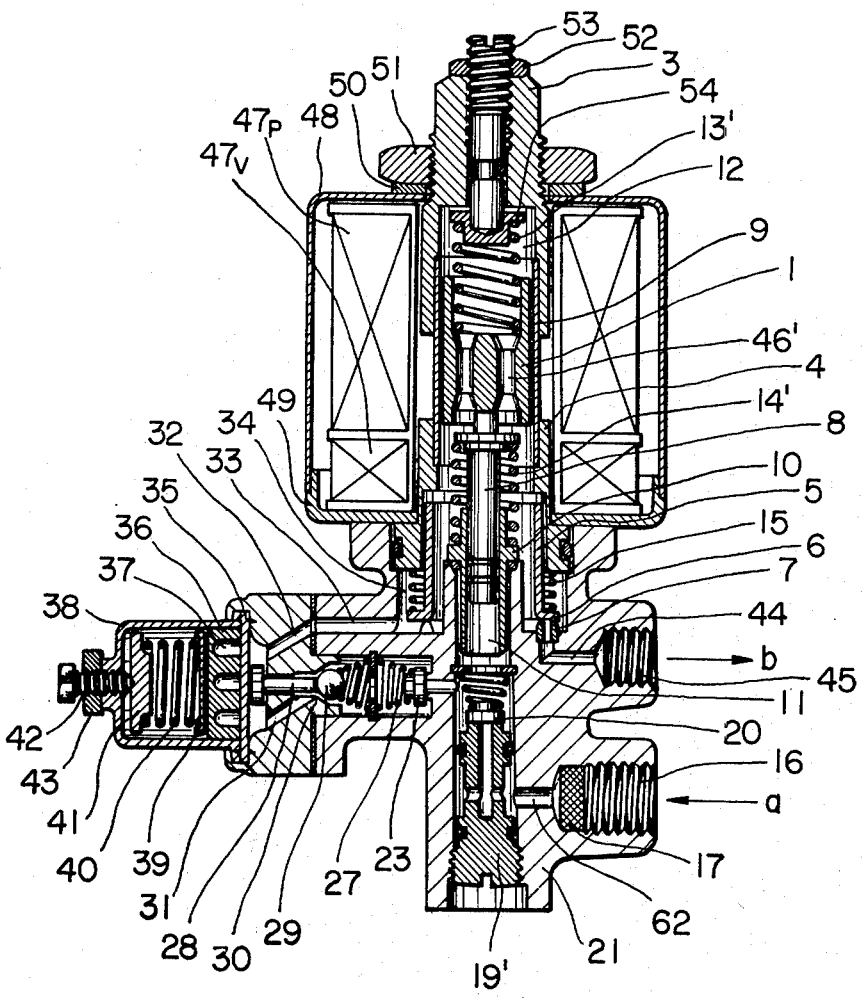
FIG. 2 is a vertical sectional view of the electromagnetic pump comprising another embodiment of the invention.

An axially disposed magnetic gap between the magnetic head 2 and the magnetic plunger 1 which is resiliently supported by the return spring 13 and auxiliary spring 14 of the same biasing force to balance and remain stationary, the relative positions of "the magnetic path 4 which forms a composite magnetic path with the movable iron member 5 and magnetically attracts the electromagnetic plunger 1 thereto when an electric current is passed to the electromagnetic coil 47" as subsequently to be described with reference to another embodiment of the invention shown in FIG. 2 and the electromagnetic coil 47, and the biasing forces of the springs 13 and 14 are important features in determining the performance of the pump. Therefore, these features should be studied carefully before conclusions are reached. It should be noted, however, that accumulation of dimensional tolerances of various parts used in the pump, irregularities in the coefficient of friction within the tolerances of roughness of the finished surfaces, irregularities in the spring constant and dimensions of the springs due to variations in tensile strength and other properties within tolerances and variations in dimensions of spring materials, and irregularities in magnetic permeability of the magnetic materials within tolerances due to variations in their composition are important factors which would cause variations in the performance of an electromagnetic pump. Even if each of these errors is small and negligible, they substantially affect the performance of the pump when such errors accumulate.

Minimization of these variations in the performance of an electromagnetic pump makes it mandatory to use those materials which have a uniform composition and high mechanical and electric properties, to work on these materials with a high degree of precision, to assemble the parts with an extraordinary degree of caution, and to effect adjustments with a high degree of skill. This would make the product extremely expensive and the production would be uneconomical. Moreover, such production process would be almost impracticable.

Under these circumstances, it would be impossible for an electromagnetic pump to demonstrate its maximum performance unless means is provided for readily effecting adjustments of the magnetic gap between the magnetic head 2 and magnetic plunger 1, the relative positions of the electromagnetic plunger 1 and the magnetic path 4 or the electromagnetic coil 47, and the biasing forces of the springs 13 and 14. The discharge pressure of a pump can be regulated by means of a pressure-reducing valve or relief valve. However, since such control valve functions when the pump operates under its maximum capacity, such valve will be of no help when the output of the pump is below the designed level due to some of the factors mentioned above. Hence there is the need to use some correcting mechanism for increasing the capability of the pump. In actual practice, when the correction mechanism is used to vary the magnetic force of attraction by adjusting the magnetic gap between the magnetic head 2 and electromagnetic plunger 1 in order to adjust the discharge pressure of a pump, a variation effected in the magnetic gap is less than 0.5 to 1 millimeter if it is desired to vary the discharge pressure of the pump from 7 $kg/cm^2$ to 10 $kg/cm^2$.

The embodiment of the invention shown in FIG. 1 is provided with a correction mechanism of the type which operates such that the magnetic gap between the magnetic head 2 and electromagnetic plunger 1 can be adjusted by turning the former either rightwardly or leftwardly. The correction mechanism is such that when the magnetic gap is reduced in area the discharge pressure of the pump can be increased. In the embodiment of the invention shown in FIG. 2, the correction mechanism is intended to increase the discharge capability of the pump by adjusting the relative positions of the electromagnetic plunger 1 and magnetic path 4 and the electromagnetic coil 47 so as to enable the electromagnetic plunger to be disposed in a magnetic field in which the magnetic force of attraction functions with the highest degree of efficiency, and by adjusting the biasing forces of the springs 13 and 14.

Although the electromagnetic pump disclosed in Japanese Laid-Open Pat. Gazette No. Sho 49-21703 incorporates therein the feature of effecting adjustments of the discharge capability of the pump, there are differences between this pump and the electromagnetic pump according to the present invention in that in the former such adjustments cannot be effected unless the pipes connected to the suction and discharge ports of the pump are removed or the screws connecting them are loosened, and that it is difficult to effect adjustments by actuating the pump without connecting pipes to the suction and discharge ports. The electromagnetic pump disclosed in Japanese Laid-Open Pat. Gazette No. Sho 48-82407 is not provided with means for increasing the discharge capability of the pump, although it has a constant pressure adjusting device of the pressure-reducing valve type. The electromagnetic pumps disclosed in the afore-mentioned patent gazettes are constructed such that a liquid entering the plunger case from its lower end flows therethrough and discharged through a discharge port connected to the upper end of the plunger case.

The plunger case of an electromagnetic pump is generally made of a nonmagnetic material and has a very small thickness in order to increase magnetic efficiency. Thus, if a bending load, tensile load or other load is applied from outside to the plunger case when an operation is performed to connect the case to a tubular portion formed with a discharge port, the plunger case tends to undergo deformation. The deformation of the plunger case often interferes with the operation of the plunger and causes a reduction in the performance of the pump or the plunger is rendered immovable in the plunger case, resulting in a serious trouble. The aforesaid trouble of the prior art is avoided in the electromagnetic pump of this invention by positioning the electromagnetic valve means such that a liquid or other fluid does not flow through the plunger case and that the suction port and discharge port for the fluid is provided in the main body of the pump.

In electromagnetic pumps of the type in which the fluid to be discharged flows through the plunger case, the electromagnetic plunger generally has a greater cross-sectional area than the discharge plunger and consequently the resistance offered to the electromagnetic plunger by the flow of the discharged fluid during the operation of the plunger is high, thereby reducing the output of the pumps. To eliminate this disadvantage, one or a plurality of vertical bores 46 (See FIG. 1) or vertical ducts 46' (See FIG. 2) are formed in the electromagnetic plunger, with the opening end of each bore or duct being gentle in slope and chamfered so as to reduce the resistance offered by the flow of the liquid. The dimensions and number of the vertical grooves 46 or vertical bores 46' must be such that their length and the cross-sectional area of the electromagnetic plunger 1 are enough to permit the necessary number of magnetic fluxes to pass therethrough. Also, they are determined depending on the mass which is capable of producing the energy of inertia necessary to cause the electromagnetic plunger to act as a spring hammer and add to the capability of the pump, and depending on the viscosity of the liquid to be handled.

If the vertical grooves 46 or vertical bores 46' are provided in the electromagnetic plunger to eliminate the resistance offered by the electromagnetic plunger to the liquid flowing through the plunger case 9, it would be possible to reduce to a certain degree the resistance offered to the electromagnetic plunger by the flow of fluid through the plunger case. It goes without saying, however, that, if means is provided whereby the flow of the liquid through the plunger case can be eliminated, there will be no resistance offered by the flow of the liquid to the electromagnetic plunger and the electromagnetic plunger will be able to operate smoothly, thereby increasing the output of the pump.

According to the present invention, no liquid flows through the plunger case 9, so that the discharge capability of the pump can be markedly increased as compared with electromagnetic plungers of the prior art.

When the electromagnetic pump according to the invention is used for delivering kerosene, light oil or other fuel oil which is relatively volatile, the oil handled tends to be gasified due to a rise in temperature caused by the passing of an electric current to the electromagnetic coil 47 and the friction developing between the electromagnetic plunger 1 and the plunger case 9, and the gas produced tends to accumulate in the plunger case 9, particularly in a spring chamber 12. Such gas is caused by the movement of the electromagnetic plunger 1 to mix with the liquid to produce a gas-liquid mixture of a high compression ratio. The presence of such gas-liquid mixture is conducive to reduced resistance offered to the movement of the electromagnetic plunger 1 and increased length of the stroke of the electromagnetic plunger, with a result that the hammering action of the electromagnetic plunger 1 is increased and the discharge capability of the pump can be increased. At the same time, the fluidity of the gas-liquid mixture promotes the cooling of the electromagnetic coil 47 which is in contact with the plunger case 9. The gas which fills the plunger case 9 as aforementioned enables the plunger case 9 to serve as an accumulator during the operation of the pump, thereby increasing the discharge capability of the pump.

A rise in temperature increases the value of electrical resistance of the electromagnetic coil 47 and reduces the value of the electric current, thereby reducing the output of the pump. However, a rise in temperature increases the gasification of the fuel oil in the plunger case 9 as aforementioned, so that the resistance offered to the operation of the electromagnetic plunger 1 is reduced for reasons set forth hereinabove. If the temperature of the electromagnetic coil 47 is low, then the value of the electric current flowing thereto is relatively high and the output of the pump is increased. Thus, even if the resistance offered to the operation of the electromagnetic plunger 1 is increased due to a decreased tendency of gasification of the fuel oil in the plunger case 9, the two effects cancel each other out and the reduction in the output of the pump due to the increase in temperature can be reduced. This is also true of a change in the atmospheric temperature of the location at which the pump is installed. In the case of fuel oil, e.g. kerosene or light oil, a change in viscosity caused by a difference in temperature does not very much affect the operation of the pump. In the case of lubricating oil and other oil of relatively high viscosity, a rise in temperature results in a reduction in viscosity. Accordingly, a reduction in the output of the pump caused by the reduction in the value of the electric current due to the rise in the value of electric resistance owing to the rise in the temperature of electromagnetic coil 47 can be compensated for by a reduction in the resistance offered to the electromagnetic plunger by the flow of the oil due to a reduction in its viscosity.

As can be appreciated in the aforesaid description of the invention, the output of the electromagnetic pump according to the invention can be maximized when the longitudinal axis of the electromagnetic coil 47 is disposed perpendicularly. It should be understood, however, that the pump can operate satisfactorily in practical use even if the longitudinal axis of the electromagnetic coil 47 is disposed transversely.

In the case of the first embodiment shown in FIG. 1, the return spring 13 may be secured at opposite ends thereof to the lower end of the magnetic path 3 and the upper end of the electromagnetic plunger 1, and the electromagnetic plunger 1 and the discharge plunger 8 can be connected together. By this arrangement, the auxiliary spring 14 can be done without and yet the pump can operate by utilizing the resilience of the return spring 13 and the intermittent magnetic force of attraction.

The electromagnetic plunger disclosed in Japanese Laid-Open Pat. Gazette No. Sho 48-82408 comprises a constant pressure adjusting device comprising a throttle valve means including an operation diaphragm and interposed between the discharge port of the discharge joint and the electromagnetic valve means. This arrangement has a disadvantage in that the liquid flows to the discharge side due to the restitution of the operation diaphragm even if the electric current to the electromagnetic coil is cut off and the electromagnetic valve means blocks the passage of the liquid. When the pump of this type is used for supplying fuel oil under pressure to a burner, there is the hazard of an accident occuring in the furnace which involves an explosion of a quantity of fuel delivered thereto after the passage of the fuel is blocked.

The aforementioned disadvantage of the prior art can be obviated by the present invention which provides a pressure control valve mechanism comprising a pressure-reducing throttle valve and concurrently functioning as an accumulator.

The operation of the pressure control valve mechanism of the afore-said construction will now be described. In the embodiment shown in FIG. 1, the electromagnetic plunger 1 is moved upwardly by the magnetic force of attraction and moved downwardly by the biasing force of the return spring 13, and the discharge plunger 8 acting as a unit with the electromagnetic plunger 1 alternately moves in a suction stroke and a discharge stroke. In the embodiment shown in FIG. 2, the electromagnetic plunger 1 is moved downwardly by the magnetic force of attraction and returned to its original upper position by the biasing force of a return spring 14', and the discharge plunger 8 acting as a unit with the electromagnetic plunger 1 alternately moves in a suction stroke and a discharge stroke. The liquid drawn by suction and discharge by this pumping action is supplied from the cylinder 11 to the pressure control mechanism through the discharge valve 23. The reason why the pressure control valve mechanism is provided in the electromagnetic plunger according to the invention which is provided with means for adjusting the discharge capability of the pump as aforementioned is that the output of the electromagnetic pump varies widely depending on changes in the voltage of the power source which is applied to the electromagnetic coil. For example, a change of ±15% in the power source voltage would cause a variation of as high as ±30% in the discharge pressure of the pump. A change in the voltage of this order often occurs in an alternating current power source generally used for a pump due to a change in the power distribution condition and the load applied to the circuit. In the face of such change in voltage, it is desired in many cases that the pump should have a discharge capability which is affected as little as possible by such change in voltage. Thus it is proper that the electromagnetic pump be adjusted to have a maximum discharge capability and yet provided with a pressure control valve mechanism which is effective to limit the discharge capability of the pump to a desired level below the maximum level. In the electromagnetic pump according to the invention, the pressure control valve mechanism performs an additional function as an accumulator which is adapted to equalize the pulses of pulsation of the liquid discharged by the pump and at the same time accumulate power.

The fluid reaching the pressure control valve mechanism passes through the valve seat 30, inlet duct 31, outlet duct 32 and communication duct 33 and reaches the electromagnetic valve chamber 34 from which it flows through the valve seat 7 and communication duct 44 to the discharge port 45 through which the fluid is discharged to outside from the main body 21. If the pressure of the fluid is increased, then the operation diaphragm 35 is pressed by the increased pressure of the fluid to thereby compress the resilient member 36 and pressure control spring 40. The result of this is that the valve 29 is moved by the biasing force of the spring 27 in a direction in which it moves toward the valve seat 30, so that the amount of the fluid passing through the valve seat 30 into the inlet duct 31 is reduced, thereby reducing the pressure of the fluid. By adjusting the biasing force of the pressure control valve 40 by turning the pressure control screw 42, it is possible to adjust the discharge pressure to a desired level at all times when the fluid is discharged at a predetermined rate of flow.

The resilience of the operation diaphragm 35, the compressibility of the gas trapped in the cavities 37 formed in the resilient member 36 maintained in intimate contact with the diaphragm 35, the resilience of the resilient member 35 itself and the resilience of the pressure control spring 40 combine to enable these members to perform a composite buffer action, to equalize the beats of the pulsating flow of the fluid and to accumulate power. As aforesaid, the operation diaphragm 35 is maintained in intimate contact with an end face of the cylindrical resilient member 36 having proper resilience, and the openings of the cavities 37 in contact of the diaphragm 35 are circular or nearly circular in shape, so that damage to the diaphragm 35 due to fatigue caused by repeated expansion and contraction and due to shear or bending can be prevented. Moreover, this causes less deformation of the diaphragm 35, ans particularly this causes less wear on a marginal portion of the diaphragm 35 which is held between the cap 38 and the valve body 26.

By incorporating the aforesaid pressure control valve mechanism of the pressure-reducing valve type in the electromagnetic pump, the pump is capable of withstanding variations in the voltage applied to the electromagnetic coil 47 and of keeping constant the pressure at which the fluid is discharged therefrom. The pressure control valve mechanism offers the additional advantage of performing the function of an accumulator. At the same time, wear of the operation diaphragm 35 of the pressure control valve mechanism can be avoided.

The major parts of the second embodiment shown in FIG. 2 have been described. Description of other parts which are designated by the same reference characters as the similar parts shown in FIG. 1 will be omitted. In the pump shown in FIG. 2, the amounts of deflection and hence the biasing forces of an auxiliary spring 13' and a return spring 14', which support under pressure applied from opposite directions the electromagnetic plunger 1 and the discharge plunger maintained in contact with each other between a spring seat 54 in abutting engagement with an adjusting screw 53 and the flange 6 of the cylinder liner 10 loosely fitted in the main body 21 and sealed airtight by an O-ring, can be varied by turning the adjusting screw 53 rightwardly or leftwardly. The distance between the electromagnetic plunger 1 and the magnetic path 4 and the relative positions of the electromagnetic coil 47 and these members can also be varied. By performing the aforesaid operations, it is possible to adjust the magnetic force of attraction applied to the electromagnetic plunger 1 and hence to adjust the discharge capability of the pump, thereby increasing its maximum output.

In the embodiment shown in FIG. 2, the electromagnetic coil consists of a coil 47*p* for operating the pump and a coil 47*v* for operating the electromagnetic valve and increasing the output of the pump, such coils 47*b* and 47*v* being superposed coaxially one on the other. The reason why the electromagnetic coil consists of two coils are presently to be described.

When the pump is used with a gun type burner for delivering and spraying fuel under pressure in atomized particles into a burner of a boiler or a heater, an intermittent electric current is first passed to the coil 47*p* to actuate the pump, and then a current is passed to the coil 47*v* to open the electromagnetic valve after lapse of several to ten-odd seconds required for a predetermined pressure necessary for ignition to be reached. By this arrangement, the fuel discharged is immediately ejected in atomized particles through a nozzle and is ignited. This is conducive to prevention of accumulation of prematurely delivered fuel in the furnace and thus to avoidance of the hazard of explosion. The present tendency is that, when the fuel oil is ignited, it is ejected in atomized particles under a discharge pressure which is lower than a discharge pressure under which the fuel oil is ejected in atomized particles when it burns under normal conditions, because this makes less noise when the fuel ignites. Thus a delay timer relay circuit is preferably connected to the coil 47*v* so that the coil 47*v* may lag behind the coil 47*p* for a predetermined time interval in being rendered operative. If the discharge pressure is slightly lowered at the time of ignition and then raised to a normal pressure after ignition of the fuel oil, the coil 47*v* will perform a magnetic action which is added to the magnetic force of attraction provided by the coil 47*p*. As a result, the output of the pump is increased after the electromagnetic valve is opened and the combustion of the fuel oil is sustained at the normal pressure. Thus the provision of the two electromagnetic coils has the effect of killing two birds with one stone.

From the foregoing description, it will be appreciated that the electromagnetic pump provided by the present invention is useful for the development of the industry, because it can eliminate environmental disruptions caused by the development of noxious gas or bad odor due to imperfect combustion of the fuel oil or the noise of explosion and can prevent the hazards of explosion and a fire.

What is claimed is:

1. An electromagnetic pump comprising an electromagnetic coil, magnetic paths arranged in said electromagnetic coil and constituting a yoke, an electromagnetic plunger arranged in a plunger case mounted in said magnetic paths in said magnetic coil for reciprocating movement along the longitudinal axis of said plunger case by the electromagnetic force and the biasing force of a return spring, a main body connected to said electromagnetic coil, said main body comprising a suction port and a discharge port for a fluid, suction and discharge valve means for drawing the fluid by suction through said suction port and discharging the same through said discharge port as said electromagnetic plunger moves in reciprocatory movement, and an electromagnetic valve chamber maintained in communication with said discharge valve means and operatively associated with the electromagnetic plunger, at least one of said magnetic paths having its cross-sectional area reduced at one end thereof which is associated with said electromagnetic valve chamber and disposed on the longitudinal axis of the electromagnetic coil so as to define a magnetic gap between outer periphery of the electromagnetic plunger and the reduced cross-sectional area portion of said magnetic path, and a movable iron member of the cylindrical shape arranged in said magnetic path to facilitate concentration and passing of lines of magnetic force necessary for the operation of the electromagnetic pump, said movable iron member being adapted to open and close a valve seat interposed between said electromagnetic chamber and said discharge port, whereby said movable iron member positively operates to open said valve seat as a result of the attempt to fill said magnetic gap as an electric current is passed to said electromagnetic plunger so as to increase the output of the electromagnetic plunger.

2. An electromagnetic pump as claimed in claim 1 wherein said movable iron member is coated on its surface with a film of a nonmagnetic metal and/or a film of a synthetic resinous material.

3. An electromagnetic pump as claimed in claim 1 further comprising a magnetic head movable along the longitudinal axis of the electromagnetic head and arranged in one of the magnetic paths which is disposed opposite to the magnetic path in which said iron member is arranged, said magnetic head and said magnetic plunger defining therebetween a magnetic gap which is variable in size as said magnetic head is turned in said magnetic path, whereby the discharge capability of the electromagnetic pump can be adjusted.

4. An electromagnetic pump as claimed in claim 3 further comprising means disposed on the longitudinal axis or its extension of said electromagnetic coil for adjusting the amounts of deflection of said return spring and an auxiliary spring resiliently supporting said electromagnetic plunger by the biasing forces thereof acting in opposite directions, such means comprising an adjusting screw and being effective to adjust the biasing forces of said springs, the distances between the electromagnetic plunger and the magnetic paths, and the relative positions of the electromagnetic plunger and the electromagnetic coil, whereby the magnetic force of attraction can be varied and the discharged capability of the electromagnetic pump can be adjusted.

5. An electromagnetic pump as claimed in claim 1 further comprising a discharge plunger slidably mounted in said main body and vertically aligned with said electromagnetic plunger, said discharge plunger being maintained in abutting engagement with a lower end of said electromagnetic plunger by the biasing force of an auxiliary spring, said discharge plunger being disposed such that it cooperates with said suction and discharge valve means.

6. An electromagnetic plunger as claimed in claim 5 further comprising means disposed on the longitudinal axis or its extension of said electromagnetic coil for adjusting the amounts of deflection of said return spring and said auxiliary spring resiliently supporting said electromagnetic plunger and said discharge plunger by the biasing forces thereof acting in opposite directions, such means comprising an adjusting screw and being effective to adjust the biasing forces of said springs, the distances between the electromagnetic plunger and the magnetic paths, and the relative positions of the electromagnetic plunger and the electromagnetic coil, whereby the magnetic force of attraction can be varied and the discharge capability of the electromagnetic pump can be adjusted.

7. An electromagnetic pump as claimed in claim 1 wherein a gas reservoir is provided at an upper portion of the plunger case so as to thereby reduce the resistance offered by a liquid to the operation of the electromagnetic plunger which acts as a free piston, whereby the action of the electromagnetic plunger as a spring hammer can be promoted and the function thereof as an accumulator can be increased.

8. An electromagnetic pump as claimed in claim 1 further comprising a pressure adjusting valve mechanism mounted in said main body and interposed between said suction and discharge valve means and said electromagnetic valve chamber to communicate therewith, said pressure adjusting valve mechanism concurrently performing the function of an accumulator and comprising a pressure-reducing throttle valve.

9. An electromagnetic pump as claimed in claim 8 wherein said pressure adjusting valve mechanism comprises a valve body secured to the main body and formed therein with a communication duct connecting the suction and discharge valve means to the electromagnetic valve chamber, a spring-loaded valve stem reciprocatorily fitted in a duct formed in the valve body, an operation diaphragm juxtaposed against and maintained in contact with said valve stem, and a resilient member disposed adjacent said operation diaphragm and urged by the biasing force of a spring into intimate contact with the operation diaphragm, said resilient member being formed therein with a plurality of cabities of a substantially circular shape having openings facing said operation diaphragm.

10. An electromagnetic pump as claimed in claim 1 wherein an opening communicating with said suction and discharge valve means is formed in the main body in a position different from the positions in which said suction port and said discharge port are disposed, said opening being normally closed but capable of being opened whereby a suction valve and/or a discharge valve of said suction and discharge valve means can be removed without disconnecting pipes connected to the suction ports and the discharge ports.

* * * * *